US006899412B2

(12) United States Patent
Hirai

(10) Patent No.: US 6,899,412 B2
(45) Date of Patent: May 31, 2005

(54) INK JET RECORDING APPARATUS AND RECOVERY MECHANISM PORTION OF INK JET RECORDING APPARATUS

(75) Inventor: Yasuyuki Hirai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/616,935

(22) Filed: Jul. 11, 2003

(65) Prior Publication Data

US 2004/0021727 A1 Feb. 5, 2004

(30) Foreign Application Priority Data

Jul. 15, 2002 (JP) ..... 2002-205618

(51) Int. Cl.[7] ..... B41J 2/165

(52) U.S. Cl. ..... 347/29; 347/30; 347/32; 347/33

(58) Field of Search ..... 347/22, 24, 29, 347/30, 32, 33

(56) References Cited

U.S. PATENT DOCUMENTS 6,371,595 B1 * 4/2002 Takemoto et al. ..... 347/33
6,550,890 B2 * 4/2003 Saijo ..... 347/29
6,742,863 B2 * 6/2004 Takahashi ..... 347/33

OTHER PUBLICATIONS

U.S. application No. 09/968,792, filed Oct. 3, 2001, (Uchida et al.) allowed, patent number pending.

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording apparatus includes a cap capable of moving in approaching and receding directions against and away from a discharge port surface of a recording unit for covering the discharge port surface, a wiper sliding while contacting with the discharge port surface to wipe the discharge port surface to clean it, a wiper driving gear for transferring drive to the wiper, a cam and gear member equipped with a cam portion for controlling the movement of the cap and a gear portion for transferring drive to the wiper driving gear, in which the cam and gear member is configured so that the gear portion engages with the wiper driving gear after the cap has moved to a position where the cap does not interfere with the wiper. By such a configuration, both of the capping operation and wiping operation can be controlled with the single cam and gear member, which makes it possible to miniaturize a recovery mechanism portion for maintaining and recovering the ink discharging performance of the recording unit. Thereby, the recording apparatus body can be miniaturized.

8 Claims, 10 Drawing Sheets

INK JET RECORDING APPARATUS AND RECOVERY MECHANISM PORTION OF INK JET RECORDING APPARATUS

BACKGROUND OF THE INVENTION

1. Field of the Invention

The present invention relates to an ink jet recording apparatus for performing recording by discharging ink from recording means to a recording material, and relates to a recovery mechanism portion of the recording apparatus.

2. Description of Related Art

A recording apparatus having a function of a printer, a copying machine, a facsimile or the like, or a recording apparatus, which is used as output equipment of a compound type electronic instrument or work station including a computer, a word processor and the like, is configured to record images (including letters, marks and the like) on recording materials (recording media), such as paper, cloth, plastic sheets, sheets for an overhead projector (OHP), or the like, on the basis of recording information. In a serial type recording apparatus, which performs recording while executing main scanning in a direction crossing with the conveyance direction of a recording medium, images are recorded with a recording head (recording means) mounted on a carriage moving along the recording medium. Having finished recording of one line, the serial type recording apparatus performs paper feeding for a predetermined pitch. After the paper feeding, the serial type recording apparatus executes the recording of the images of the next line on the recording material, which has stopped again after the paper feeding. The serial type recording apparatus performs the recording on the whole recording medium by repeating the above-mentioned recording operation. On the other hand, in a line type recording apparatus, which performs recording only in the conveyance direction of a recording material, the recording material is set at a predetermined position, and the recording of a line is performed at once. After that, paper feeding for a predetermined pitch is performed, and the recording of the next line is performed at one time. The line type recording apparatus repeats the above-mentioned recording operation to perform the recording on the whole recording material.

Among the above-mentioned recording apparatuses, an ink jet recording apparatus, which performs recording by discharging ink from a recording head to a recording material, can easily miniaturize recording means, and can record highly fine images at a high speed. Furthermore, the ink jet recording apparatus can perform recording on a sheet of plain paper without special processing. Moreover, the running cost of the ink jet recording apparatus is inexpensive, and the noise of the ink jet recording apparatus is minimal since the ink jet recording apparatus adopts a nonimpact system. Besides, the ink jet recording apparatus can easily record color images by the use of many kinds of inks (for example, color inks). The ink jet recording apparatus has the advantages described above. Moreover, demands for the quality of the recording materials used in the ink jet recording apparatus are various, and recently development meeting these demands has made progress. In addition to ordinary recording paper, a resin thin plate (for an OHP and the like), cloth, leather, nonwoven fabric, metal and the like has begun to be used.

In the ink jet recording apparatus, recording is performed by discharging ink from fine discharge ports. Consequently, when ink is increased in viscosity or dried due to evaporation of liquid ink components (evaporation of a solvent) in the vicinity of the discharge ports, or when ink or dust such as paper powder is attached to a discharge port surface, or further when bubbles intrude into ink in the discharge ports, not only discharging of the ink becomes unstable, but also faulty discharges of ink, undischarged states of ink and the like are sometimes produced.

Accordingly, a recovery mechanism portion for maintaining and recovering the ink discharge performance of a recording head as recording means in a good state is provided. As recovery means in the recovery mechanism portion, there are wiping means, capping means, suction means and the like. The wiping means wipes an discharge port surface to clean it (wiping cleaning) by sliding a wiper made of an elastic member such as rubber or the like on the discharge port surface to rub the discharge port surface for cleaning the discharge port surface by removing unnecessary ink attached to the ink discharge port surface due to ink mist or ink drops rebounded from a recording material and foreign matter such as paper powder attached to the ink discharge port surface during recording operations.

When ink has not been discharged for a long time from a recording head, the ink in discharge ports sometimes evaporates and dries, and the discharge ports are plugged up. Consequently, bad discharging, such as unstable discharging, undischarged states or the like, is sometimes caused. The capping means caps (closes up tightly) the discharge port surface of a recording head during the time when recording is not performed to reduce or to prevent the increase in viscosity or the fixing of ink owing to the evaporation and the drying of the ink in the discharge ports of the recording head. Moreover, when air bubbles intrude into the recording head, or when the ink discharge ports are clogged owing to the increase in viscosity or the fixing of the ink attached to the ink discharge port surface to dry, the suction means produces a negative pressure in the cap with a suction pump communicating with the cap in the state in which the discharge port surface of the recording head is shut tightly with the cap. Thereby, the suction means exhausts the ink discharge ports and exchanges the ink in the ink discharge ports with fresh ink to maintain and to recover normal ink discharging.

As the configuration of the wiping means, the configuration of performing wiping and cleaning with a wiper made of a rubber-like elastic member moving in the arrangement direction of the ink discharge ports of the recording head is frequently adopted. Moreover, from the point of view of preventing the increase of the width of a recording apparatus, the cap and the wiper are configured so as to overlap each other, so that the wiper passes between the cap and the discharge port surface when the cap is separated from the discharge port surface. Moreover, as one of the driving methods of the cap, the method of making the cap approach or recede against or away from the discharge port surface by means of a lever or the like, which is driven to rotate with a cam member for cap control, is adopted. Moreover, as one of the driving methods of the wiper, the method of moving the wiper in rectilinear reciprocating directions (for example, forward and reverse directions) with a cam, a rack and pinion, a lead screw, or the like is adopted. Thus, the wiper is configured to pass between the cap and the discharge port surface when the cap is separated from the discharge port surface. In this case, the wiper is frequently moved from an upstream side to a downstream side along a discharge port train while the wiper is made to slide to rub the discharge port surface to wipe the discharge port surface to clean it.

However, in the recovery mechanism portion including the wiping means of the system of driving the wiper with the cam, the rack and pinion, or a mechanism formed by combining them, a larger cam member or a longer rack member becomes necessary as the movement distance of the wiper becomes longer owing to the increase of the area of the discharge port surface. Consequently, the apparatus body becomes larger, which in turn makes it difficult to implement the miniaturization of the recording apparatus. Moreover, in the recovery mechanism portion including the wiping means of the system of driving the wiper by the use of the lead screw, it becomes necessary to form an approach section of a predetermined distance from a starting position of the operation of the wiper lest the wiper should overlap the cap until the cap is sufficiently separated from the discharge port surface.

However, if the approach section is formed to be sufficiently long, the size of the recording apparatus body in the front-to-rear direction increases to make it difficult to miniaturize the recovery mechanism portion or the recording apparatus. Even if the pitch of the lead screw in the approach section is changed, the wiper moves within the approach section. Consequently, the size of the recording apparatus body in the front-to-rear direction becomes larger by the movement distance.

SUMMARY OF THE INVENTION

An object of the present invention is to provide an ink jet recording apparatus capable of miniaturizing a recovery mechanism portion for maintaining and recovering the ink discharging performance of recording means, and thereby capable of realizing the miniaturization of the recording apparatus body, and to provide the recovery mechanism portion of the recording apparatus.

The present invention is an ink jet recording apparatus for performing recording by discharging ink from recording means to a recording material, the apparatus including a cap capable of moving in approaching and receding directions against and away from a discharge port surface of the recording means for covering the discharge port surface, a wiper sliding while contacting with the discharge port surface to wipe the discharge port surface to clean it, a wiper driving gear for transferring drive to the wiper, a cam and gear member equipped with a cam portion for controlling movement of the cap and a gear portion for transferring drive to the wiper driving gear, in which the cam and gear member is configured so that the gear portion engages with the wiper driving gear after the cap has moved to a position where the cap does not interfere with the wiper.

According to the present invention, since in an ink jet recording apparatus for performing recording by discharging ink from recording means to a recording material, the apparatus includes a cap capable of moving in approaching and receding directions to and away from a discharge port surface of the recording means for covering the discharge port surface, a wiper sliding while contacting with the discharge port surface to wipe the discharge port surface to clean it, a wiper driving gear for transferring drive to the wiper, and a cam and gear member equipped with a cam portion for controlling movement of the cap and a gear portion for transferring drive to the wiper driving gear, in which the cam and gear member is configured so that the gear portion engages with the wiper driving gear after the cap has moved to a position where the cap does not interfere with the wiper, both of the capping operation and wiping operation can be controlled with the single cam and gear member, which makes it possible to miniaturize a recovery mechanism portion for maintaining and recovering the ink discharging performance of the recording means. Thereby, an ink jet recording apparatus in which the recording apparatus body can be miniaturized is provided.

DETAILED DESCRIPTION OF THE PREFERRED EMBODIMENTS

Figure 1:
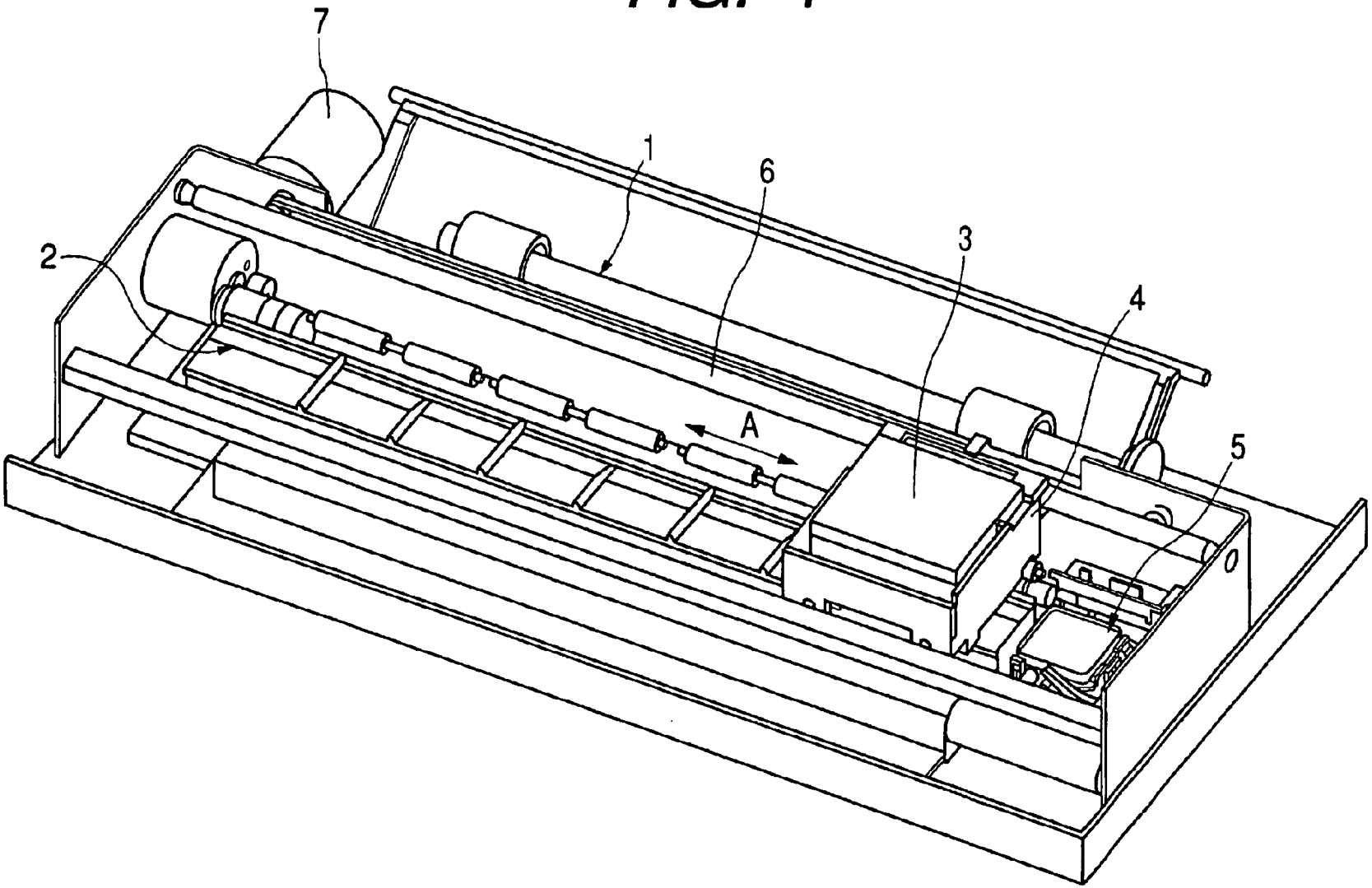
FIG. 1 is a schematic perspective view showing an embodiment of an ink jet recording apparatus to which the present invention is applied.

In the following, the attached drawings are referred to while the preferred embodiments of the present invention are concretely described. Incidentally, the same reference numerals designate the same or corresponding components throughout the drawings.

First Embodiment

FIG. 1 is a schematic perspective view showing an embodiment of an ink jet recording apparatus to which the present invention is applied. In FIG. 1, the ink jet recording apparatus is provided with a paper feeding portion 1 for feeding a recording material such as recording paper to a recording position, a paper conveying portion 2 for conveying the recording material, a carriage 4 for moving (performing main scanning) along the recording material while mounting a recording head 3 as recording means thereon, and a recovery mechanism portion 5 for maintaining and recovering the ink discharge performance of the recording head 3 appropriately. The carriage 4 is supported to be guided by a guide shaft 6 in a state capable of moving reciprocally. The carriage 4 is driven to move in the directions of a two-directional arrow A in FIG. 1 by a carriage motor 7 as a driving source.

As will be described later, the recovery mechanism portion 5 is provided with capping means for protecting an ink discharge portion of the recording head 3 during the time when recording is not performed, wiping means for wiping the ink discharge portion (a discharge port surface) to clean it, suction means for effecting suction of ink from discharge ports in the state of capping the ink discharge portion, and the like. The recording head 3 is ink jet recording means for discharging ink by means of thermal energy. The recording head 3 is equipped with electrothermal conversion members for generating the thermal energy. Moreover, the recording head 3 generates film boiling in ink by means of the thermal energy applied by the electrothermal conversion members to discharge the ink from the discharge ports by means of pressure changes owing to the growth and shrinkage of air bubbles generated by the film boiling. Thereby, the recording head 3 performs recording (printing).

Figure 2:
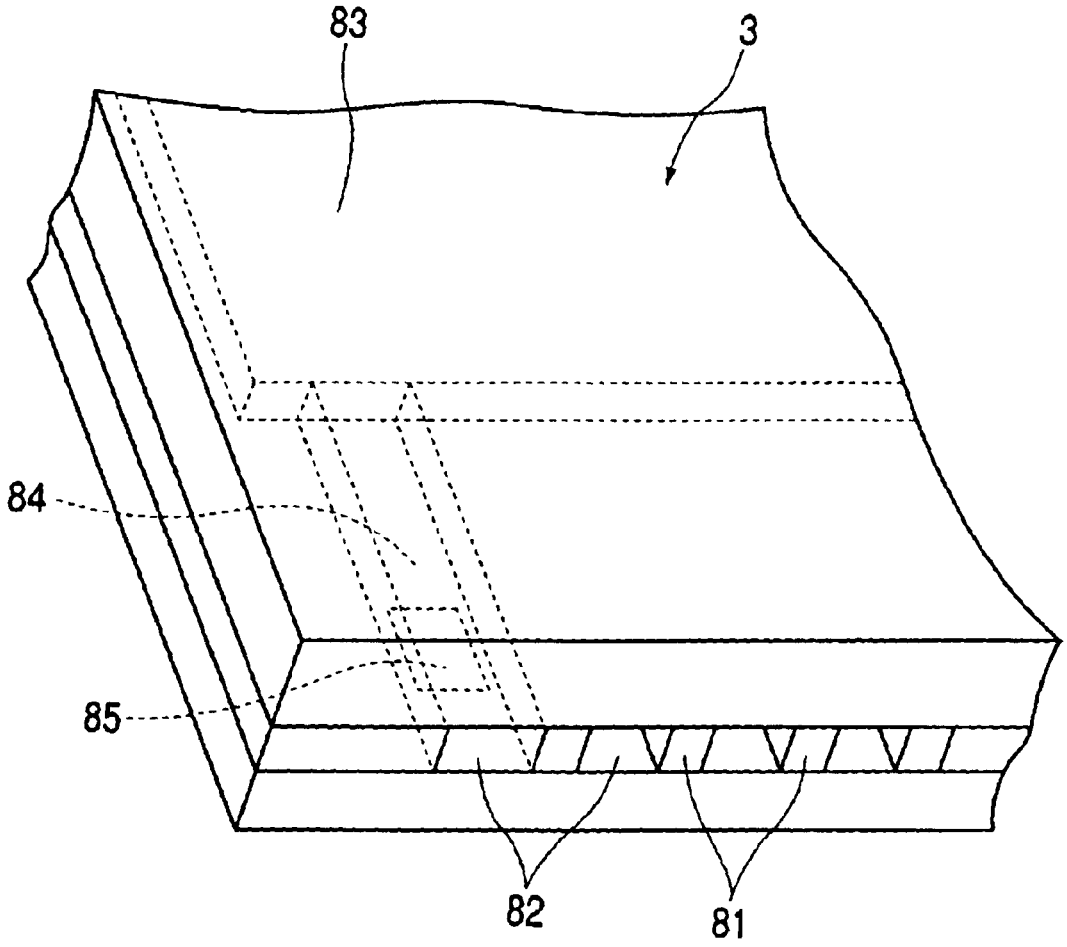
FIG. 2 is a partial perspective view showing the structure of an ink discharge portion of recording means in FIG. 1.

FIG. 2 is a partial perspective view showing the structure of the ink discharge portion of the recording head 3 schematically. In FIG. 2, a discharge port train composed of a plurality of discharge ports 82 arranged at a predetermined pitch is formed on a discharge port surface 81 opposed to a recording material (a recording medium), such as recording paper or the like, with a predetermined gap (e.g., about 0.2 mm to about 2.0 mm). Electrothermal conversion members (such as heat elements or the like) 85 for generating energy for discharging ink are distributed along the wall surfaces of respective liquid paths 84 making the respective discharge ports 82 communicate with a common liquid chamber 83. The recording head 3 is mounted on the carriage 4 in a positional relationship in which the plural discharge ports 82 are arranged in a direction crossing with the main scanning direction (the moving direction of the recording head 3). Thus, the recording head (recording means) 3 is configured to discharge ink from the discharge ports 82 by means of the pressure generated at the time of the film boiling of the ink in the liquid paths 84 caused by the driving (current carrying) of the corresponding electrothermal conversion members 85 on the basis of an image signal or a discharge signal.

Figure 3:
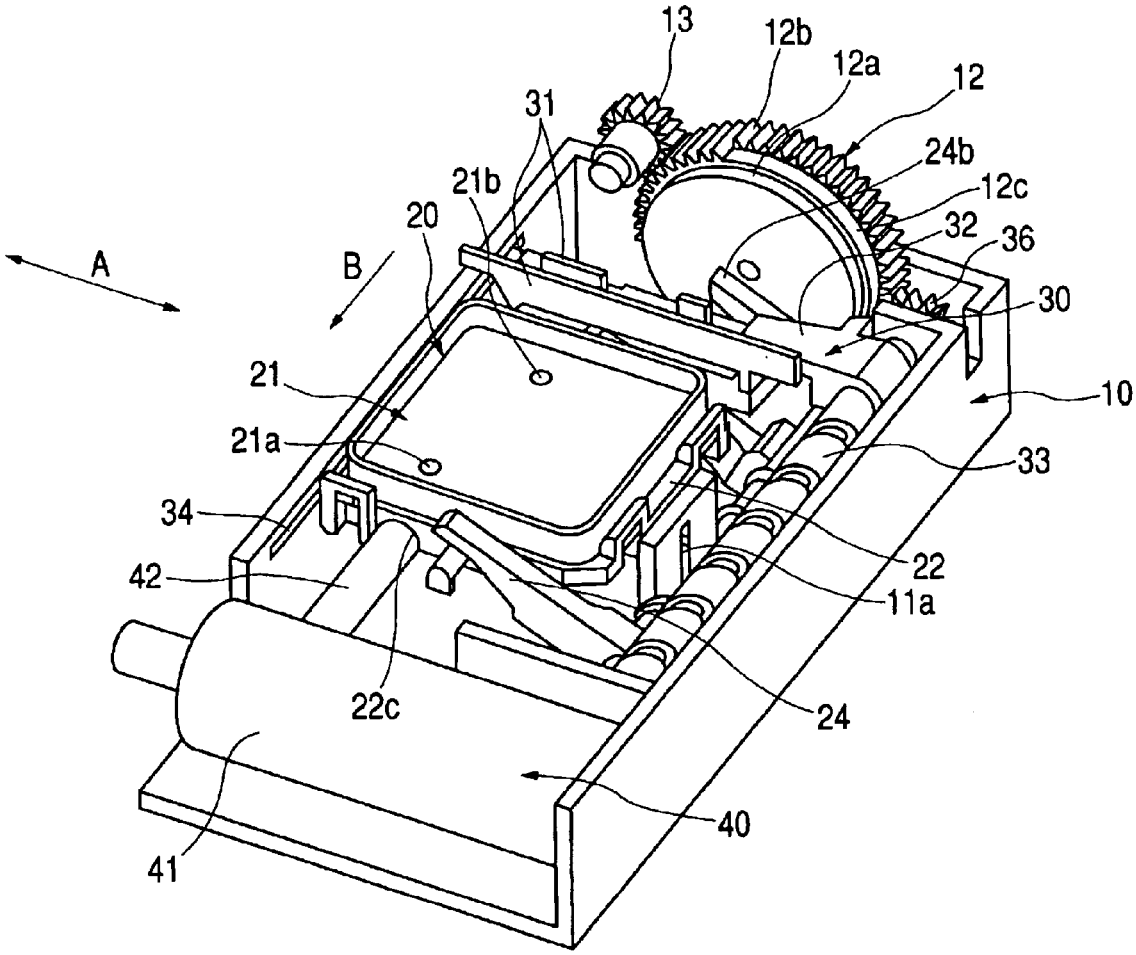
FIG. 3 is a schematic perspective view showing the configuration of a first embodiment of a recovery mechanism portion of the ink jet recording apparatus to which the present invention is applied.
Figure 4:
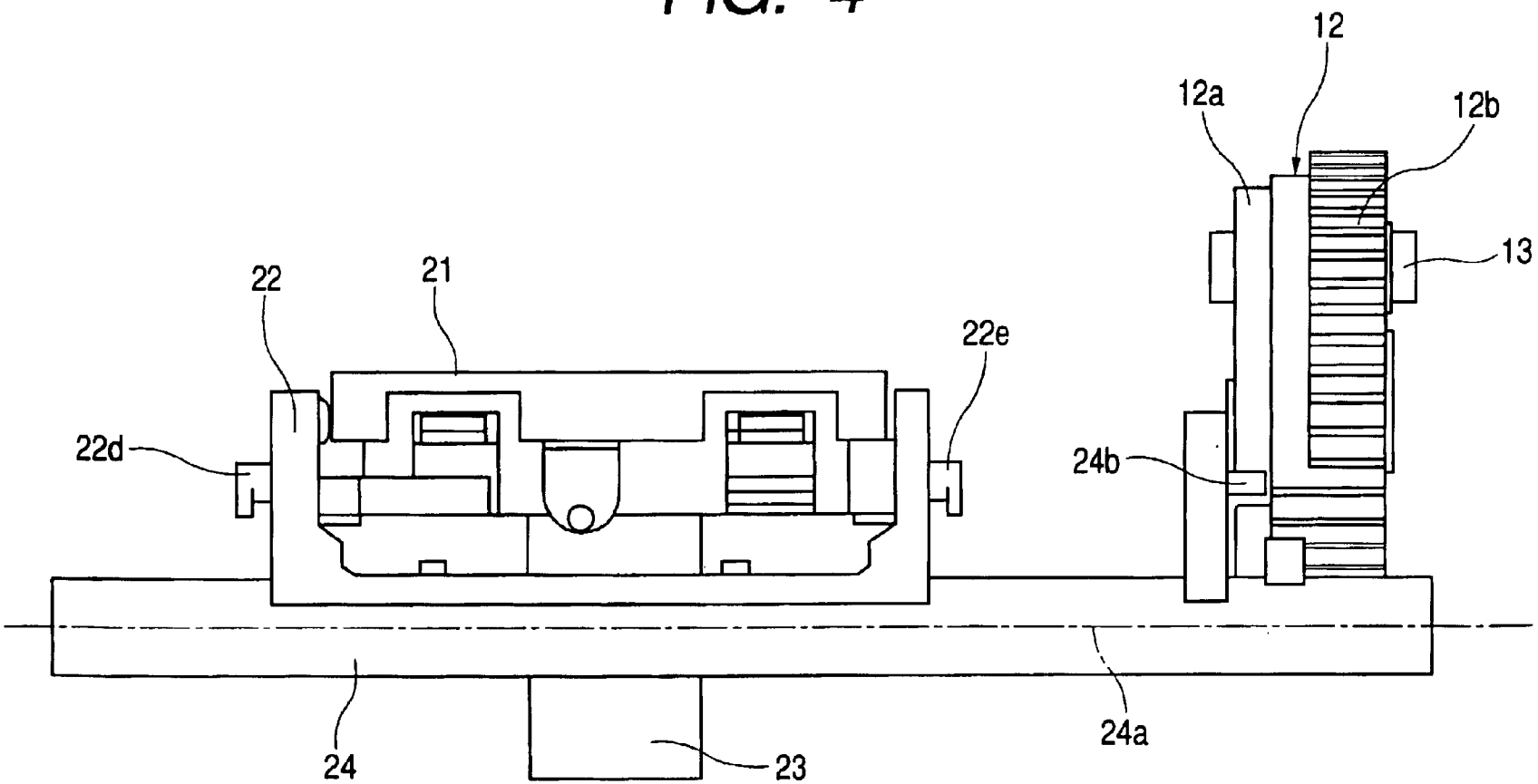
FIG. 4 is a schematic side view showing a cap driving portion of the recovery mechanism portion of FIG. 3.

FIG. 3 is a schematic perspective view showing the structure of a first embodiment of the recovery mechanism portion 5 to which the present invention is applied. FIG. 4 is a schematic side view showing a cap driving portion of the recovery mechanism portion 5 of FIG. 3. In FIG. 3, the recovery mechanism portion 5 is composed of capping means (a cap portion) 20, wiping means (a wiper portion) 30 and suction means (a suction pump portion) 40 as recovery means. These components of the recovery means are disposed on a base portion 10 of the recovery mechanism portion 5. The two-directional arrow A in FIG. 3 indicates the moving directions of the carriage 4 mounting the recording head 3 thereon.

In FIGS. 3 and 4, a reference numeral 21 designates a cap made of an elastic material, such as rubber, an elastomer or the like, for sealing the discharge port surface 81 of the recording head 3 hermetically. Moreover, the cap 21 is attached to a rigid cap holder 22, and is configured to press against and seal the discharge port surface 81 of the recording head 3 when no recording is performed, or when a suction recovery is performed. The cap 21 includes an ink suction port 21*a* and an air communication port 21*b*. The ink suction port 21*a* is connected to a suction pump 41. The air communication port 21*b* communicates with the air. Incidentally, the air communication port 21*b* is opened or closed with an air communication port opening/closing lever (not shown).

Moreover, a cap absorber (not shown) is housed in the cap 21. The cap absorber is disposed to be opposed to the discharge port surface 81 of the recording head 3 with a predetermined gap between them at the time of capping. The cap holder 22 is attached in a state capable of being translated (in the vertical direction in the example shown in FIG. 3) along guide grooves 11*a* and 11*b* (one guide groove 11*b* is not shown) equipped on the base portion 10. The cap holder 22 is urged toward the recording head 3 by a cap spring 23 (shown in FIG. 4) mounted between the base portion 10 and the cap holder 22.

When the cap 21 is separated from the discharge port surface 81 of the recording head 3 (when the cap 21 is lowered in the example shown in the figures), the cap holder 22 is pressed in a direction away from the discharge port surface 81 (the cap holder 22 is pushed down in the example shown in the figures) by a lever member (a cap lever) 24 to move the cap 21. The cap lever 24 is attached to be rotatable around a shaft center 24*a* (shown in FIG. 4) provided on the base portion 10 of the recovery mechanism portion 5. An end portion (a cam surface abutting portion) 24*b* of the cap lever 24 moves along the curved surface of a cam portion (a peripheral surface cam) of a cam and gear member 12, which is driven to rotate. That is, a position of the cap 21 relative to the recording head 3 (a position in an approaching or receding direction) is determined on the basis of a rotation position of the lever member (the cap lever) 24 based on a driven rotation position of the cam and gear member 12.

In FIG. 3, a wiper 31 for wiping and cleaning (cleaning) the discharge port surface 81 of the recording head 3 is attached to a wiper holder 32. A lead screw 33 is rotatably pivoted on the base portion 10. The lead screw 33 is inserted into an end portion of the wiper holder 32, and the other end portion of the wiper holder 32 on the opposite side of the lead screw 33 is fitted to a guide portion (a rail or a groove formed on the base portion 10) 34. The guide portion 34 is formed parallel with the discharge port train formed on the discharge port surface 81 of the recording head 3 together with the lead screw 33. A protruding portion (not shown) of the wiper holder 32 is engaged with a spiral groove formed on the surface of the lead screw 33. Consequently, when the lead screw 33 rotates, the wiper holder 32 is translated into the arrangement direction of the discharge port train. Accompanying the translation of the wiper holder 32, the wiper 31 slides to rub the discharge port surface 81 of the recording head 3, and wipes a section including the discharge port train to clean it (performs wiping off cleaning thereof).

In the present embodiment, the wiping and cleaning of the discharge port surface 81 is performed in the direction of the wiper 31 moving from the rear of the recording apparatus body (the inner side in FIG. 3) to the front (in the direction of an arrow B in FIG. 3). After the wiper 31 has passed the discharge port surface 81, the wiper 31 abuts a wiper cleaner (not shown) to remove the ink or the foreign matter which is attached to the wiper 31. With regard to the wiper 31, the present embodiment is configured as described above. A wiper driving gear 36 is fixed to an end portion of the lead screw 33. On the other hand, the cam and gear member 12 is rotatably pivoted on the base portion 10. A cam portion 12*a* and a gear portion 12*b* are formed on the cam and gear member 12. The gear portion 12*b* is composed of a portion including a toothless portion 12*c* and a portion without a toothless portion (a gear portion on its entire periphery).

The portion including the toothless portion 12*c* of the gear portion 12*b* is disposed to be able to engage with the wiper driving gear 36, and the portion without a toothless portion of the gear portion 12*b* is always engaged with a driving gear 13. Thus, the embodiment is configured to transfer drive for rotating the lead screw 33 to the wiper driving gear 36 through the cam and gear member 12. Hereupon, an idler gear (not shown) may be provided between the gear portion 12*b* of the cam and gear member 12 and the wiper driving gear 36 for adjusting the moving speed of the wiper 31, or the rotation speed of the lead screw 33.

Figure 6:
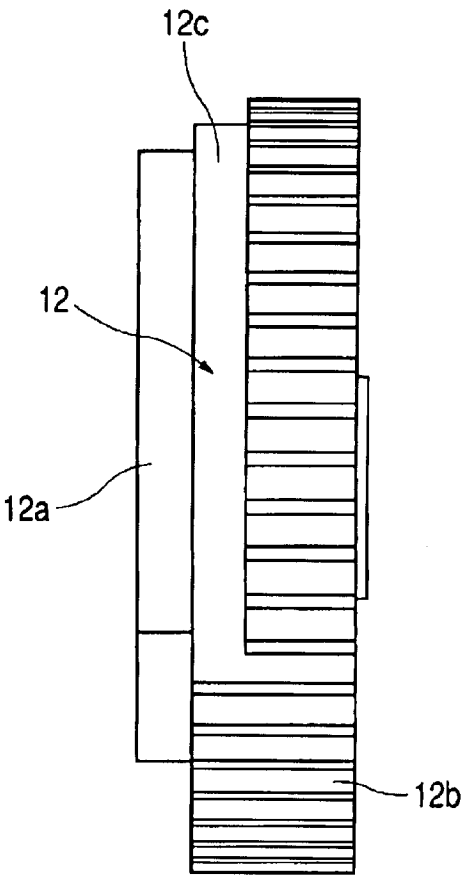
FIG. 6 is a side view of the cam and gear member in FIG. 5.
Figure 5:
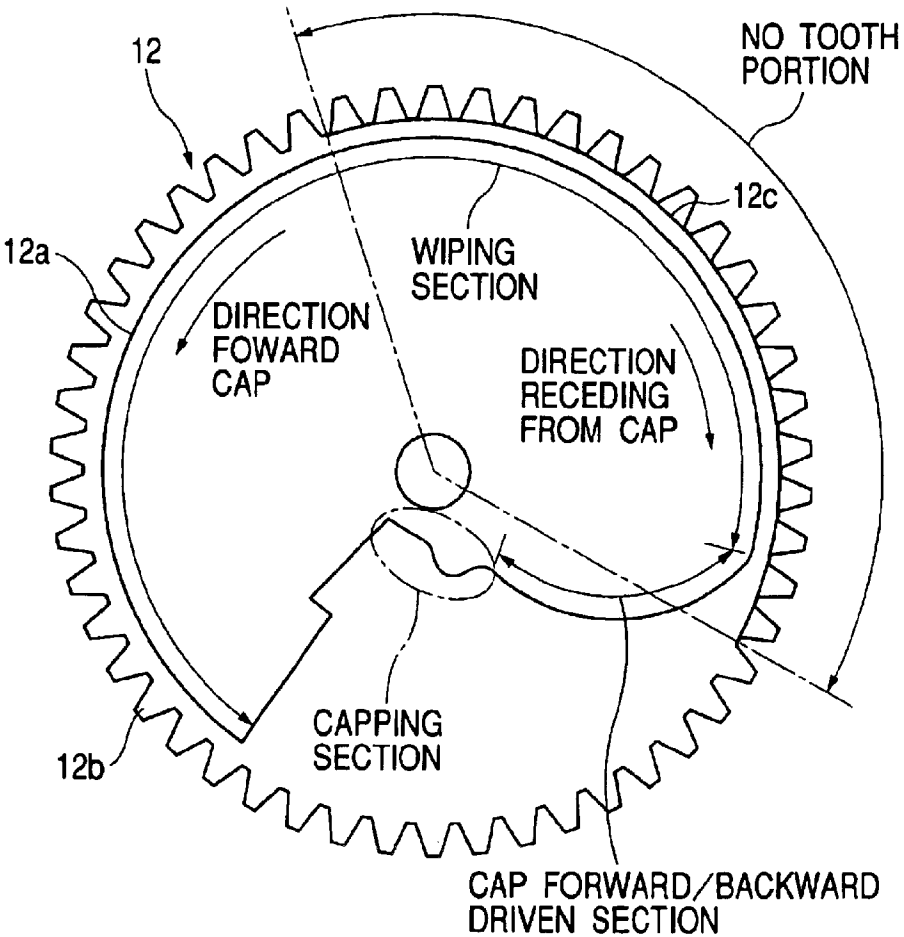
FIG. 5 is a schematic front view showing a cam and gear member in FIGS. 3 and 4.

FIG. 5 is a schematic front view of the cam and gear member 12 of FIGS. 3 and 4, and FIG. 6 is a side view of the cam and gear member 12 of FIG. 5. In FIGS. 3 to 6, the cam and gear member 12 is provided with the cam portion 12*a* for driving the cap 21 in an approaching or receding direction against or away from the recording head 3, and the gear portion 12*b* for transferring the drive to the wiper driving gear 36 to make the wiper 31 operate. The cam and gear member 12 is rotatably pivoted on the base portion 10 of the recovery mechanism portion 5. On the cam portion 12*a* are formed a wiping section (a section corresponding to the toothless portion 12*c* of the gear portion 12*b*, which will be described later) for making the wiper 31 operate when the cap 21 is at a position where the cap 21 is most distant from the recording head 3 (the most retracted position corresponding to the lowest point in the example shown in the figures), a cap forward/backward driven section for making the cap 21 move in the approaching or receding direction relative to the recording head 3, and a capping section for making the cap 21 adhere closely to the discharge port surface 81 of the recording head 3.

A portion for opening the air communication port 21*b* of the cap 21 by means of an air communication port opening/closing lever (not shown) is formed in the scope of the capping section. A toothless section is formed in a part of the gear portion engaging with the wiper driving gear 36 of the gear portion 12*b* for limiting the drive to be transferred to the wiper driving gear 36 only when the cam and gear member 12 is in the wiping section (an angle range for wiping). In FIG. 3, the reference numeral 41 designates the suction pump, which is connected with a tube joint portion 22*c* of the cap holder 22 through a tube 42, and which is further led to the inside of the cap 21 through the ink suction port 21*a*. Consequently, by making the suction pump 41 operate while covering the discharge port surface 81 with the cap 21 (a capping state), it is possible to generate a negative pressure in the cap 21. As the suction pump 41, for example, a tube pump, a cylinder pump or the like is used.

Figure 7:
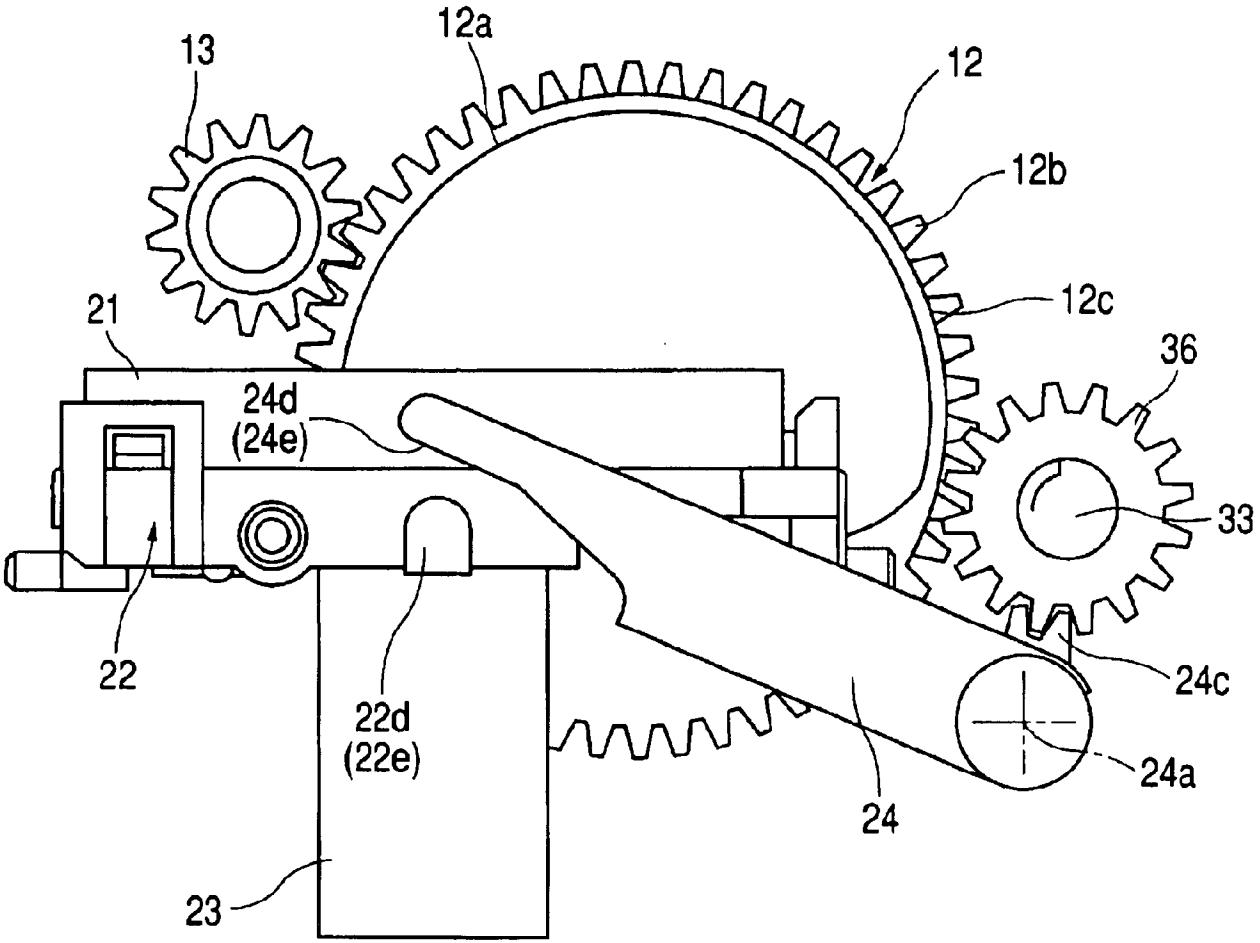
FIG. 7 is a front view showing the cap driving portion and a wiper driving portion of the recovery mechanism portion of FIG. 3 in a state at the time of the capping of a recording head.
Figure 8:
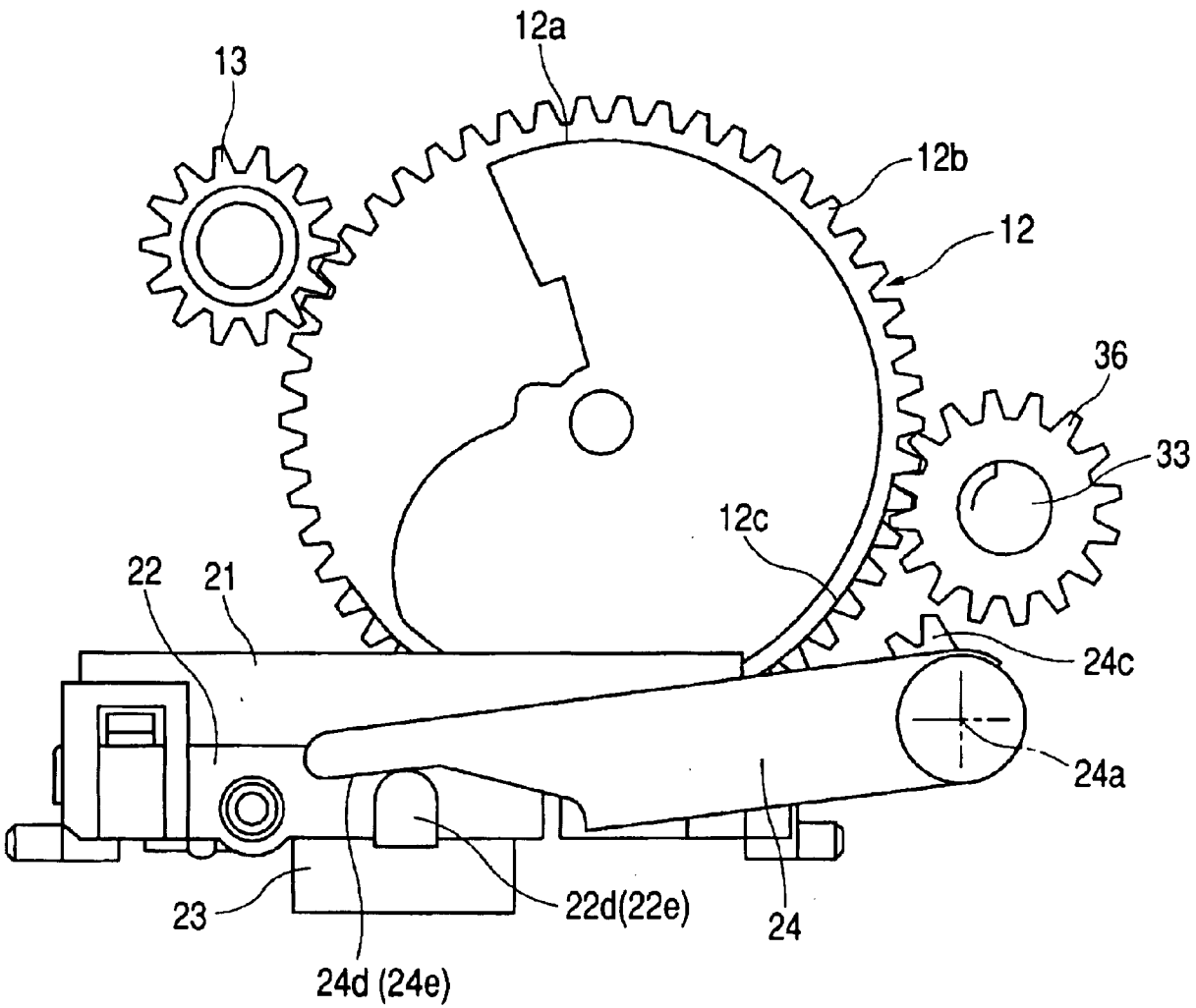
FIG. 8 is a front view showing the cap driving portion and the wiper driving portion of FIG. 7 in a state at the time of separating the cap.

FIG. 7 is a front view showing the cap driving portion and a wiper driving portion of the recovery mechanism portion 5 of FIG. 3 in a state at the time of the capping of the recording head 3. FIG. 8 is a front view showing the cap driving portion and the wiper driving portion of FIG. 7 in a state at the time of separating the cap 21. Next, FIGS. 7 and 8 are referred to while the approaching or receding operation of the cap 21 and the sliding and contacting operation (forward/backward moving operation) of the wiper 31 are described. The driving gear 13 is rotated by a driving source (not shown) such as a recovery system motor or the like, and the cam and gear member 12 is in turn rotated through the driving gear 13. Then, the end portion 24*b* (the cam surface abutting portion) of the cap lever 24 moves in accordance with the movement (rotation) of the cam portion 12*a*, and the cap lever 24 rotates. In the example shown in the figures, when the cam and gear portion 12 rotates clockwise, the cap lever (the lever member) 24 rotates counterclockwise around the shaft (the shaft center) 24*a* thereof in the figures.

When the cap lever 24 rotates counterclockwise as shown in the figures, surfaces 24*d* and 24*e* (abutting portions; the unshown surface 24*e* is formed on the side opposite to the surface 24*d*) of the cap lever 24 push down boss portions 22*d* and 22*e* of the cap holder 22. Thereby, the cap 21 moves in the direction receding from the recording head 3. Incidentally, a predetermined area of the gear portion 12*b* for transferring the drive to the wiper driving gear 36 is formed to be the toothless portion. Consequently, when the cap 21 is at the capping position and when the cap 21 is moving in the approaching or the receding direction, the drive is not transferred to the wiper driving gear 36. Therefore, the wiper 31 remains at a waiting position (a retracting position or a home position) distant from the recording head 3.

When the cap lever 24 has further rotated counterclockwise shown in the figures so that the cap 21 has reached the most distant position from the recording head 3 (the lowest position in the example shown in the figures), the gear portion 12*b* of the cam and gear member 12 begins to engage with the wiper driving gear 36. When the cam and gear member 12 is further rotated, a driving force is transferred to the lead screw 33 through the wiper driving gear 36. Then, the lead screw 33 rotates to move the wiper 31 in the direction of the arrow B in FIG. 3 (the direction from the rear to the front of the recording apparatus). The movement of the wiper 31 makes the end portion of the wiper 31 slide to contact with (slide to rub) the discharge port surface 81 of the recording head 3 to execute the wiping and cleaning (the wiping off cleaning) of the discharge port surface 81. Then, the wiper 31 passes through the discharge port surface 81 to move up to a predetermined position on the opposite side (the front of the recording apparatus).

In this state, when the cam and gear member 12 is rotated counterclockwise as shown in the figures by rotating the driving source (not shown), such as the recovery system motor or the like, inversely, the lead screw 33 is inversely rotated, and the wiper 31 first moves in a returning direction (a d irection from the front to the rear of the recording apparatus in the example shown in the figures). After that, the end portion 24*b* of the cap lever 24 moves along the cap portion 12*a*, and thereby the cap lever 24 rotates clockwise in the figures to be separated from the boss portions 22*d* and 22*e* of the cap holder 22. Consequently, the cap 21 and the cap holder 22 are urged toward the recording head 3 by the spring force of the cap spring 23, so that the cap 21 adheres closely to the discharge port surface 81 of the recording head 3. Thereby, the discharge ports 82 are shut tightly (are capped).

A tooth form 24*c* as stopper means is provided on the cap lever 24 as shown in FIGS. 7 and 8. When the wiper driving gear 36 is opposed to the toothless portion 12*c* of the gear portion 12*b* of the cam and gear member 12 so that no drive is transferred to the wiper driving gear 36, the tooth form 24*c* is engaged with the wiper driving gear 36 as shown in FIG. 7, and the tooth form 24*c* functions as stopper means for preventing unnecessary movement of the wiper driving gear 36. Then, when the cap lever 24 has rotated until the cap 21 has reached the most distant position from the discharge port surface 81 of the recording head 3 (the most retracted position or the lowest position in the figures; when the cap lever 24 reaches the state in FIG. 8), the engagement of the tooth form 24*c* with the wiper driving gear 36 is broken off and the wiper driving gear 36 is in the rotatable state.

Second Embodiment

Figure 9:
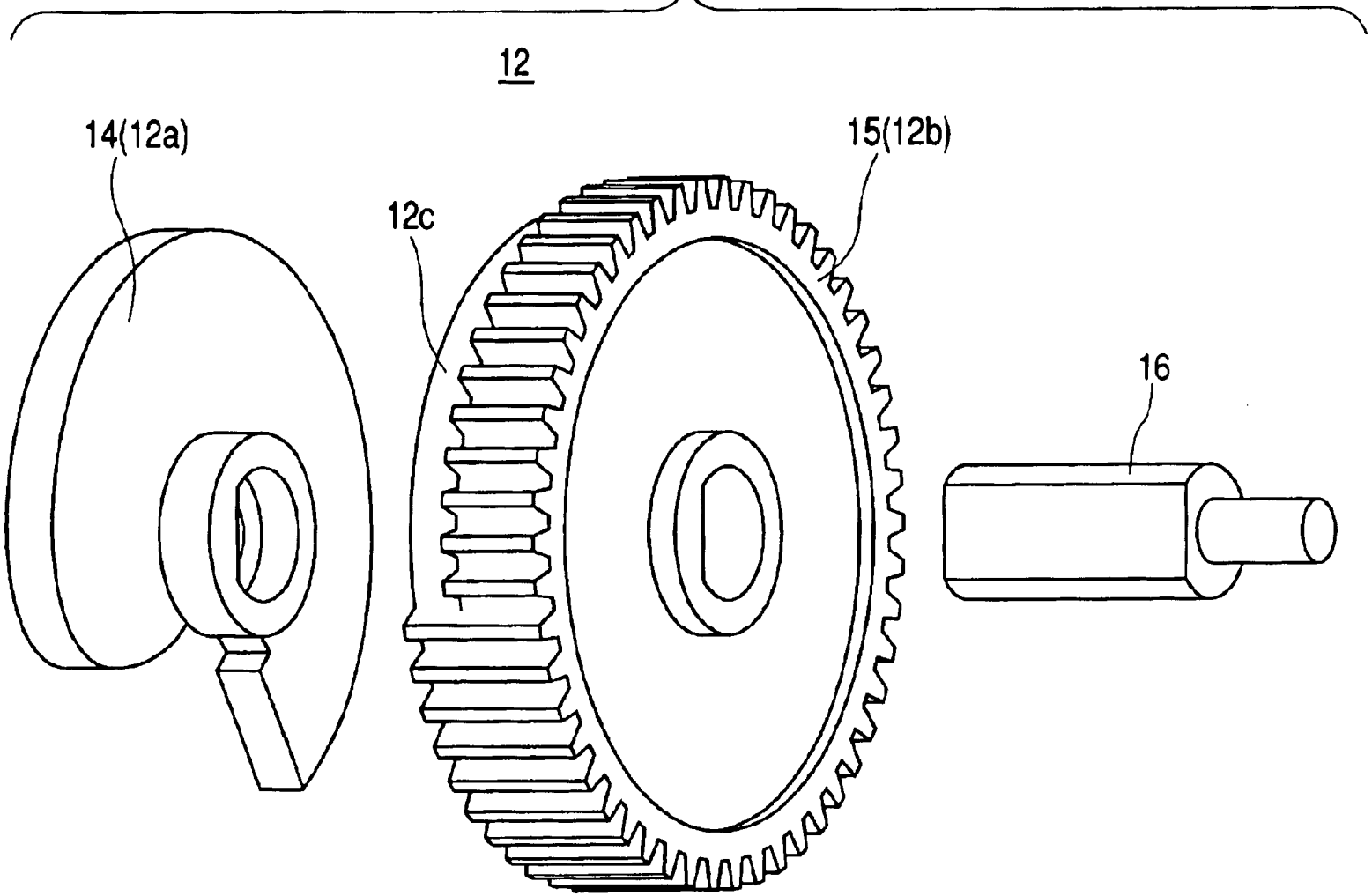
FIG. 9 is an exploded perspective view showing the configuration of a cam and gear member in a second embodiment of the recovery mechanism portion of the ink jet recording apparatus to which the present invention is applied.

FIG. 9 is an exploded perspective view showing the configuration of a cam and gear member 12 in a second embodiment of the recovery mechanism portion 5 of the ink jet recording apparatus to which the present invention is applied. In the cam and gear member 12 of the first embodiment described above, the cam portion (the cam portion driving the cap 21) 12*a* and the gear portion (the gear portion transmitting drive to the wiper driving gear 36) 12*b* are integrally formed to be a single member. However, the cam and gear member 12 in the present embodiment is formed as individual parts 14 and 15. Then, a shaft 16 is inserted into the individual parts 14 and 15 with pressure to assemble and connect them to rotate at the same phase. Thus, the individual parts 14 and 15 are integrally configured. The cam and gear member 12 integrated in the above-mentioned way is rotatably mounted on the base portion 10 of the recovery mechanism portion 5 together with the shaft 16. Incidentally, the example shown in FIG. 9 is configured to rotate the cam 14 (the cam portion 12*a*) and the gear 15 (the gear portion 12*b*) at the same phase. That is, a hole having a cross-section in the shape of the letter D is formed in the centers of the cam 14 and the gear 15, which are formed as separate components. Then, the shaft 16 having the same D-shaped cross-section is pressed to be inserted into the D-shaped holes. The present embodiment differs from the first embodiment described above in the manner described above. However, the other portions of the present embodiment are configured to be substantially the same as those of the first embodiment.

Third Embodiment

Figure 10:
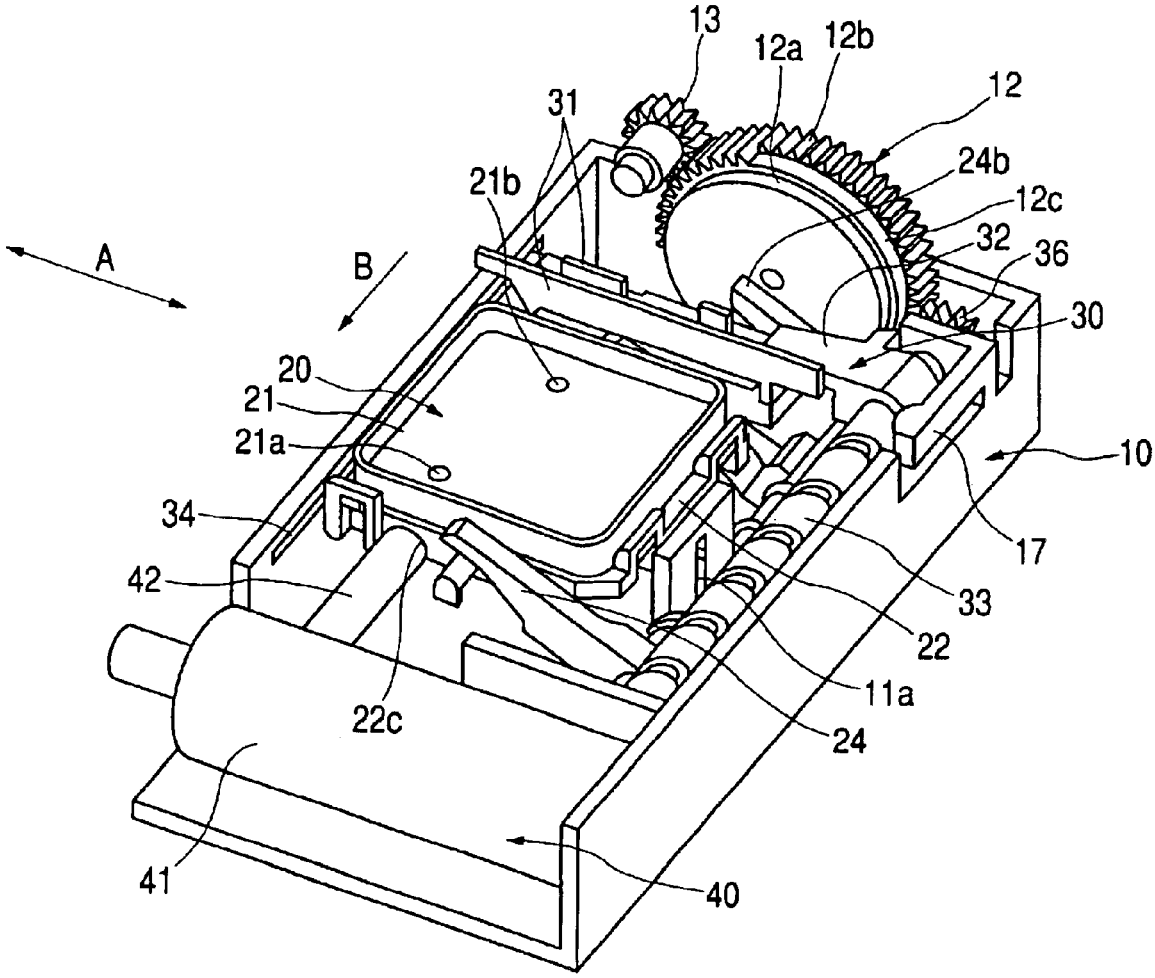
FIG. 10 is a schematic perspective view showing a third embodiment of the recovery mechanism portion of the ink jet recording apparatus to which the present invention is applied.

FIG. 10 is a schematic perspective view showing a third embodiment of the recovery mechanism portion 5 of the ink jet recording apparatus to which the present invention is applied. In the first embodiment described above, the tooth form 24*c* formed integrally with the cap lever 24 as the stopper means for preventing the movement (rotation) of the wiper driving gear 36 when no drive is transferred to the wiper driving gear 36 is used. However, the present embodiment uses a click claw 17, which is capable of being elastically displaced and which is formed integrally with the base portion 10 of the recovery mechanism portion 5 in place of the tooth form 24*c*. The click claw 17 includes a claw portion to engage with a side face of the wiper holder 32, and the click claw 17 is formed to hold the wiper holder 32 at the waiting position (shown in FIG. 10) with an elastic force by engaging the claw portion with the side face of the wiper holder 32. Moreover, the click claw 17 may be configured not to be integral with the base portion 10, but to be fixed at a predetermined position as an individual member capable of being elastically displaced. Although the present embodiment is different from each of the embodiments described above in the manner described above, the other components of the present embodiment are substantially the same as those of the embodiments described above. The corresponding components are designated by the same reference numerals as those of the preceding embodiments, and the detailed description of the components is omitted.

Fourth Embodiment

Figure 11:
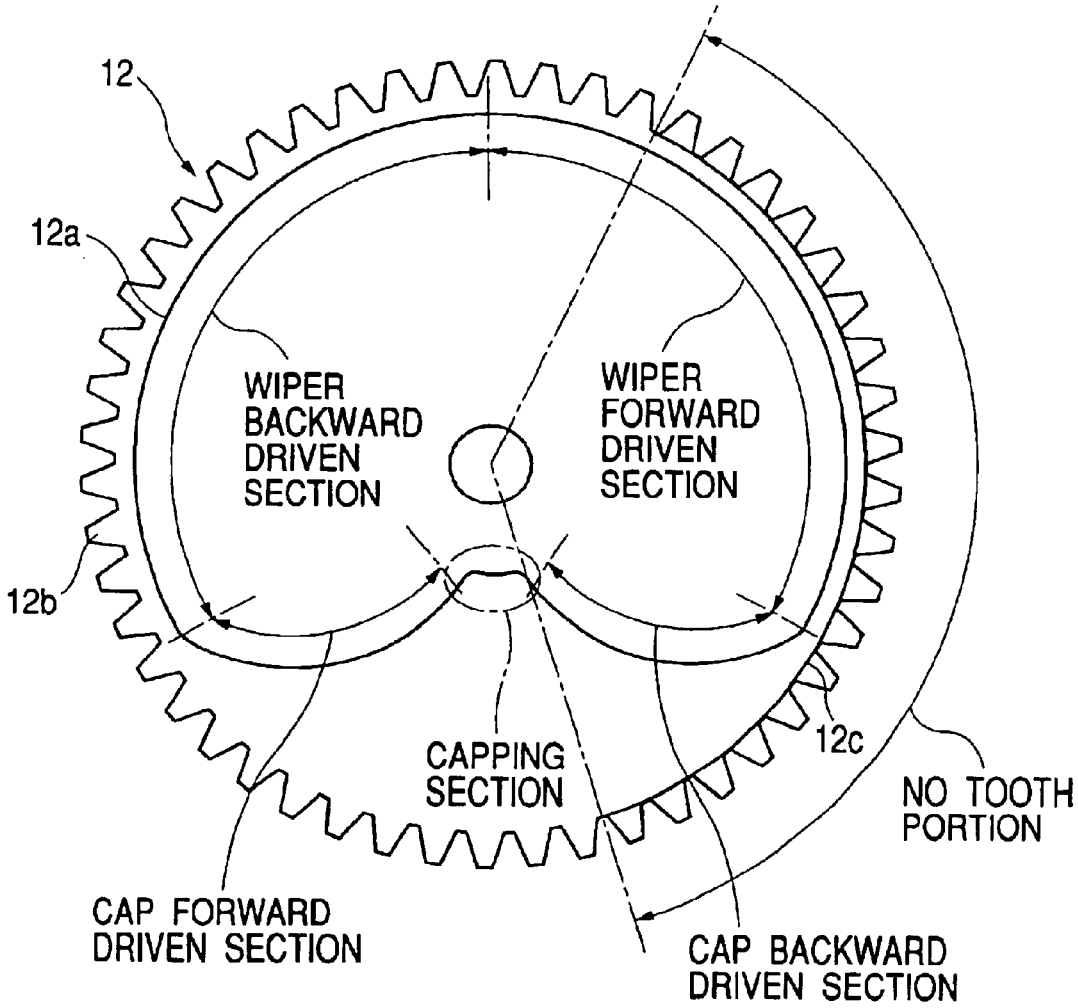
FIG. 11 is a schematic front view of a cam and gear member in a fourth embodiment of the recovery mechanism portion of the ink jet recording apparatus to which the present invention is applied.

FIG. 11 is a schematic front view of a cam and gear member 12 in a fourth embodiment of the recovery mechanism portion 5 of the ink jet recording apparatus to which the present invention is applied. Each of the embodiments described above adopts the configuration in which the cam and gear member 12 is made to be rotatable in both of the forward and the backward directions, and in which only a one-way lead groove is formed on the lead screw 33. However, when the cam and gear member 12 can be formed by the use of a member having a relatively large diameter, or when the driving stroke (a necessary movement distance) of the wiper 31 may be relatively short, the cam and gear member 12 may be configured as follows. That is, the configuration of the cam and gear member 12 is shaped to include a wiper forward driven section and a wiper backward driven section which are symmetrically arranged, and a cap backward driven section and a cap forward driven section which are symmetrically arranged, as a fourth embodiment shown in FIG. 11. Furthermore, a lead groove (a guide groove) which makes it possible to move the recovery mechanism 5 reciprocally by rotations of the lead screw 33 in one direction is formed on the lead screw 33. Thereby, the capping operation and the wiping operation can be performed by the use of only the rotations of the driving source (not shown), such as the recovery system motor or the like, in one direction.

Incidentally, in the embodiments described above, a serial type ink jet recording apparatus performing a recording operation while moving the recording head 3 as the recording means in the main scanning direction is exemplified as described. However, the present invention can be similarly applied to a line type ink jet recording apparatus performing recording by executing only sub-scanning by the use of a line type ink jet head having the length covering the entire width or a part of the width of a recording material. Similar advantages can be obtained also by the line type ink jet recording apparatus. Moreover, the present invention can be freely implemented regardless of the number of recording heads. In addition to an ink jet recording apparatus using one recording head, the present invention can be similarly applied to a color ink jet recording apparatus using a plurality of recording heads using different kinds of color inks, a gradation ink jet recording apparatus using a plurality of recording heads using the inks having the same color and different densities, and an ink jet recording apparatus made by combining the ink jet recording apparatuses described above. In such ink jet recording apparatuses, similar advantages can be obtained.

Moreover, the present invention can be similarly applied to any configurations of the arrangements of a recording head and an ink tank such as a configuration using an exchangeable head cartridge composed of a recording head and an ink tank which are integrated to be one body, a configuration using an individual recording head and an individual ink tank which are connected to each other with an ink feeding tube, and the like. In such cases, similar advantages are also obtained. Incidentally, the present invention can be applied to, for example, an ink jet recording apparatus using an electromechanical transducer such as a piezoelectric element or the like. However, among all, the present invention can obtain superior advantages when the invention is applied to an ink jet recording apparatus using an ink jet recording head that discharges ink by means of thermal energy, because high density and high resolution recording (printing) can be realized by a such type of ink jet recording head.

What is claimed is:

1. An ink jet recording apparatus for performing recording by discharging ink from recording means to a recording material, said apparatus comprising:

a cap capable of moving in approaching and receding directions against and away from a discharge port surface of the recording means, said cap being for covering the discharge port surface;

a wiper sliding while contacting with the discharge port surface to wipe the discharge port surface to clean the discharge port surface;

a wiper driving gear for transferring drive to said wiper; and a cam and gear member including a cam portion for controlling movement of said cap and a gear portion for transferring drive to said wiper driving gear, said cam and gear member configured so that said gear portion and said wiper driving gear are engaged with each other after said cap has moved to a position where said cap does not interfere with said wiper.

2. An ink jet recording apparatus according to claim 1, wherein said wiper passes between said cap and the discharge port surface after said cap has moved to the position where said cap does not interfere with said wiper.

3. An ink jet recording apparatus according to claim 1, wherein said cam portion and said gear portion of said cam and gear member are formed as a single, integral component, and said cam portion and said gear portion are assembled to rotate at a same phase for forming said cam and gear member.

4. An ink jet recording apparatus according to claim 1, wherein a wiper holder mounting said wiper thereon is moved by a lead screw.

5. An ink jet recording apparatus according to claim 1, wherein said cap is held by a cap holder, and said cap approaches toward or recedes away from the discharge port surface by a rotation of a lever member engaging with said cam portion and said cap holder.

6. An ink jet recording apparatus according to claim 1, further comprising stopper means for regulating movement of said wiper when said gear portion is not engaged with said wiper driving gear.

7. An ink jet recording apparatus according to claim 6, wherein said stopper means comprises a tooth form capable of engaging with said wiper driving gear, said tooth form formed on a lever member engaging with said cam portion and said cap holder.

8. A recovery mechanism portion of an ink jet recording apparatus for performing recording by discharging ink from recording means to a recording material, said recovery mechanism portion comprising:

a cap capable of moving in approaching and receding directions toward and away from a discharge port surface of the recording means, said cap being for covering the discharge port surface;

a wiper sliding while contacting with the discharge port surface to wipe the discharge port surface to clean the discharge port surface;

a wiper driving gear for transferring drive to said wiper; and a cam and gear member including a cam portion for controlling movement of said cap and a gear portion for transferring drive to said wiper driving gear, said cam and gear member configured so that said gear portion and said wiper driving gear are engaged with each other after said cap has moved to a position where said cap does not interfere with said wiper.

* * * * *

UNITED STATES PATENT AND TRADEMARK OFFICE

CERTIFICATE OF CORRECTION

PATENT NO. : 6,899,412 B2
APPLICATION NO. : 10/616935
DATED : May 31, 2005
INVENTOR(S) : Hirai It is certified that error appears in the above-identified patent and that said Letters Patent is hereby corrected as shown below:

ON THE TITLE PAGE,
In the drawing, "FOWARD" should read --TOWARD--.
Item (57), Abstract, line 14, "wiping" should read --the wiping--.

IN THE DRAWINGS
Sheet 5, FIG. 5, "FOWARD" should read --TOWARD--.

COLUMN 8
Line 38, "d irection" should read --direction--.

COLUMN 10
Line 54, "a such" should read --such--.

Signed and Sealed this

Fifth Day of June, 2007

JON W. DUDAS
*Director of the United States Patent and Trademark Office*